US006084485A

United States Patent [19]

Bickford et al.

[11] Patent Number: 6,084,485

[45] Date of Patent: Jul. 4, 2000

[54] BROAD-BANDWIDTH BALUN WITH POLYIRON CONES AND A CONDUCTIVE ROD IN A CONDUCTIVE HOUSING

[75] Inventors: Joel David Bickford; Julius K Botka, both of Santa Rosa, Calif.

[73] Assignee: Agilent Technologies, Inc., Palo Alto, Calif.

[21] Appl. No.: 09/240,185

[22] Filed: Jan. 29, 1999

[51] Int. Cl.[7] ..... H01P 5/10

[52] U.S. Cl. ..... 333/26; 343/859

[58] Field of Search ..... 333/25, 26; 343/859

[56] References Cited

PUBLICATIONS

Phelan, "A Wide–Band Parallel–Connected Balun," IEEE Transactions on Microwave Theory and Techniques, vol. MTT–18, No. 5, May 1970.

Maas, Stephen A.; "Microwave Mixers", Artech House, Inc., Second Edition 1993, Chapters, 1, 7.1, 8.3 and 10.3.

Marchand, Nathan; "Transmission–Line Conversion", Electronics, vol. 17, Dec. 1944, pp. 142–145.

Cloate, J. H., "Exact Design of the Marchand Balun", Proceedings of the Ninth European Microwave Conference, Sep. 17–120, 1979, pp. 480–484.

Cloate, J. H.; Graphs of Circuit Elements for the Marchand Balun, Microwave Journal, May 1981, pp. 125–128.

*Primary Examiner*—Justin P. Bettendorf

[57] ABSTRACT

The invention provides a balun capable of operation over a range including micro and millimeter wavelengths. The balun includes a set of ferrite beads, and a set of polyiron cones. The ferrite beads and polyiron cones together provide signal balancing operable across a bandwidth together provide a signal balancing operable across a range of bandwidths of about 5000 to 1.

10 Claims, 2 Drawing Sheets

BROAD-BANDWIDTH BALUN WITH POLYIRON CONES AND A CONDUCTIVE ROD IN A CONDUCTIVE HOUSING

FIELD OF THE INVENTION

The invention relates to baluns, and, in particular, broadband baluns such as are suitable for use in microwave and millimeter wave frequency mixers.

BACKGROUND OF THE INVENTION

Electrical signals need to be balanced to maximize power in many transmission situations. A device for balancing signals is a balun. A balun converts, for example, an unbalanced coaxial local oscillator feed signal to balanced mode, permitting the balanced mode signal to switch the diode.

In diode based frequency mixers, baluns are generally required to convert an unbalanced coaxial local oscillator feed signal to a balanced mode signal which switches the diode. Baluns may also be used on the RF input signal. The degree of electrical balance between the two balun outputs is very important in preventing input signal energy from exiting the other mixer ports. Ideally, the balun should not create large reflections or insertion losses such that the finction is degraded.

Currently in use in some 2–50 gigahertz mixers is a Marchand balun. A Marchand balun consists of two coupled sections, each one quarter wavelength long. Each section has one terminal grounded, and the load is connected between the terminals opposite the grounded ones (it can also be used, like the parallel-line balun, as a phase splitter driving two loads). The structure is surrounded by a ground plane, usually the housing in which the balun is mounted. A balun of this type has a limit of 10 to 1 maximum bandwidth. For RF signals between 20 and 50 gigahertz, the third harmonic of the local oscillator is used to mix with the RF frequencies to extend the RF frequency. Such extension, however, is at the expense of poorer conversion loss and increased noise problems.

Another balun commonly used in broadband mixers is the microstrip balun. The microstrip balun involves a tapered microstrip ground plane. Mixers with this balun provide a bandwidth of about up to about 26 to 1. This balun must be about a wavelength or longer in electrical length to function properly. As a result, the practical use is limited to microwave frequencies and higher.

Presently, in order to achieve aggregate bandwidth for broad band instruments, two or more baluns and associated mixers have been incorporated in a broadband instrument, at additional bulk and cost. As applications become increasing portable, reduction in bulk and cost are essential.

There has grown and there remains a need for baluns that are capable of performing across a broad range of frequencies, from millimeter to microwave.

What is needed is a single broadband balun operable over a range spanning millimeter wavelengths to below ten gigahertz wavelengths.

SUMMARY OF THE INVENTION

The invention provides a broadband balun capable of operating over a range spanning megahertz frequencies to frequencies often gigahertz and above. The invention further provides a transmission line balun with a conductive housing, a coaxial transmission line electrically connected to the conductive housing. A tip of the outer conductor of the coaxial transmission line passing through a ferrite beads and a polyiron cone within the conductive housing. A conductive rod inserts into the opposite end of the conductive housing and is electrically connected to the conductive housing. The conductive rod passes through a second ferrite bead and a second polyiron cone within the conductive housing. The tip of the conductive rod forms an electrical contact which connects with the inner conductor of the first transmission line in approximately the center portion of the conductive housing such that a small gap is formed between the tip of the coaxial line and the tip of the conductive rod to provide balanced broadband output signals in a frequency range from several megahertz to several gigahertz.

DETAILED DESCRIPTION OF THE PREFERRED EMBODIMENT

Figure 1A:
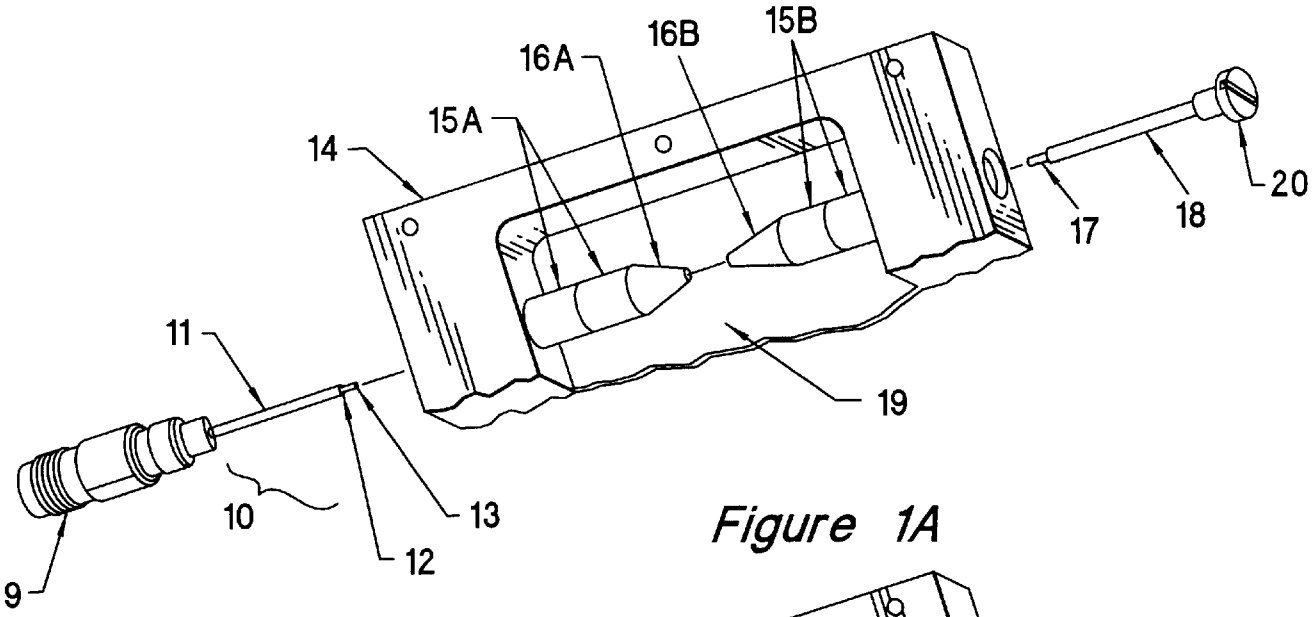
FIG. 1, A and B inclusive, represents the mechanical structure of the invention in the preferred embodiment.
Figure 1B:
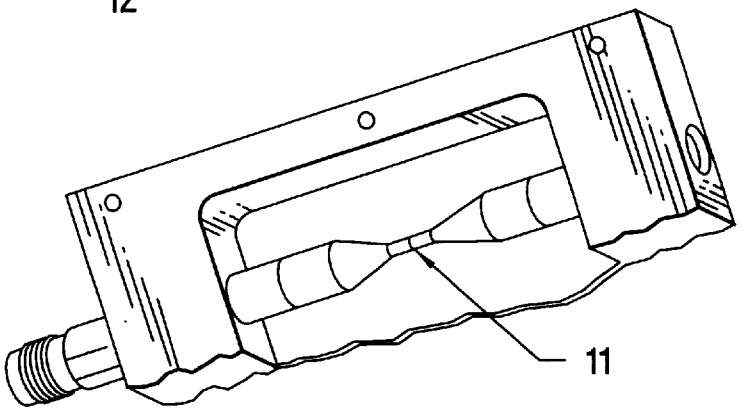

The mechanical construction of a balun according to the invention is depicted in FIGS. 1A and 1B. A coaxial connector 9 transmits an input signal to a coaxial transmission line 10 connected thereto, where coaxial transmission line 10 has an outer conductor and an inner conductor 13. The coaxial transmission line 10 passes through one end of a conductive housing 14; the conductive housing 14 is electrically coupled to the coaxial transmission line 10 through contact with the outer conductor of the coaxial transmission line 10.

The outer conductor of the coaxial transmission line 10 having a tip 12 that passes through a first a first ferrite bead 15A and a first polyiron cone 16A, within the conductive housing 14.

At the opposite end of the conductive housing 14 and electrically connected thereto is a conductive rod 18. The conductive rod 18 passes through the wall of the conductive housing 14 and passes through a a second ferrite bead 15B and a second polyiron cone 16B within the conductive housing, the tip 17 of the conductive rod 18 forming electronic contact which connects with the inner conductor 13 of the coaxial transmission line 10 in approximately the center portion of the housing 14 such that a relatively small gap 11 is formed between the coaxial line 10 and the tip 17 of the conductive rod 18 to provide balanced broadband output signals in a frequency range form several megahertz to several gigahertz.

In the preferred embodiment, the tip 17 of the conductive rod 18 is drilled, cross slotted and formed so as to provide a standard female electrical contact which connects with the inner conductor 13 of the coaxial line 10 in the approximate center of the housing 14. The conductive rod 18 is securably inserted into the housing 14, in the preferred embodiment by a thread 20 which is screwed into the housing 14.

Figure 2A:
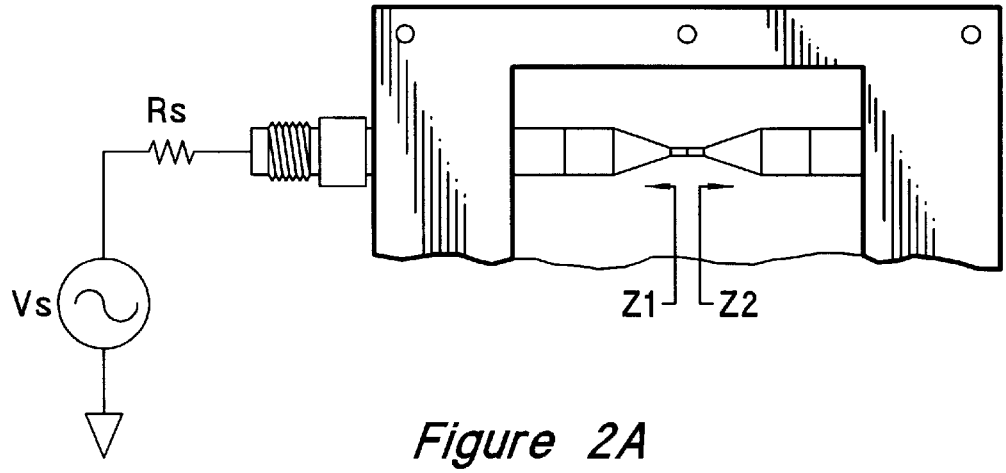
FIG. 2, A and B inclusive, represent the electrical circuit equivalence of the preferred embodiment.

The balanced output signal is taken across a small gap 11 between the tip 12 of the outer conductor of the coaxial line 10 and the tip 17 of the conductive rod 18 (see FIG. 2A).

Figure 2B:
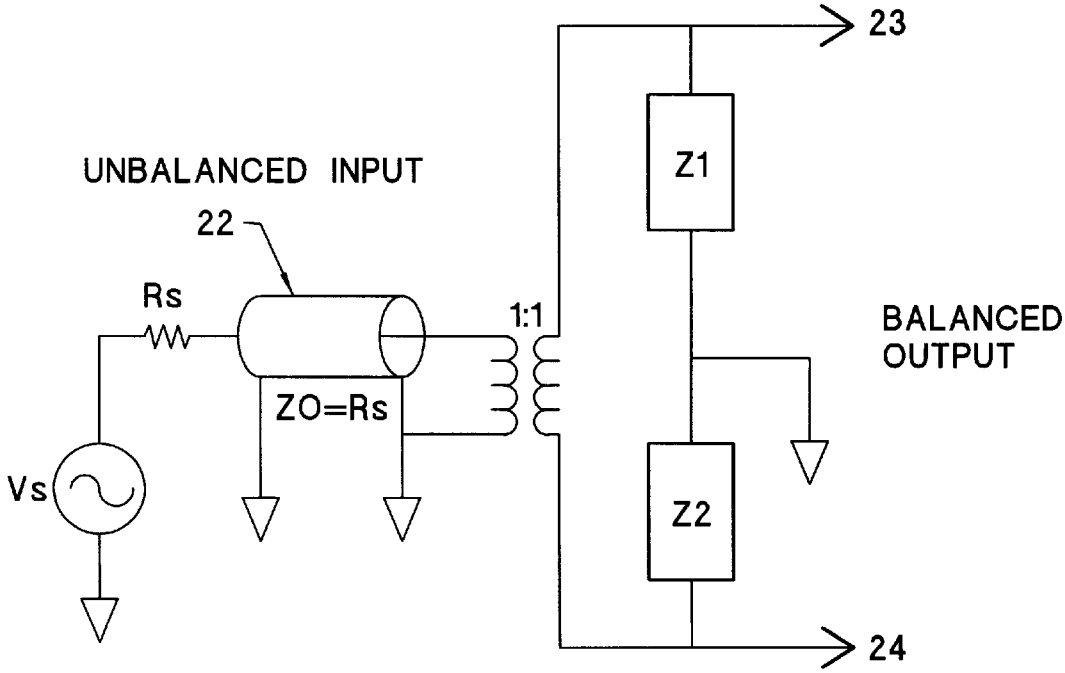

The equivalent electrical schematic of the balun provided by the invention in illustrated in FIGS. 2A and 2B. Vs and Rs are the unbalanced signal generator source voltage and resistance. The first unbalanced out coaxial line 22 represents the coaxial feed 22 through the input connector. Balanced output is represented in the circuit diagram 23, 24.

The inner surfaces of the conductive housing 19 are considered to be at ground potential. Z1 represents the impedance to ground from the tip of the outer conductor of the coaxial line. Z2 represents the impedance to ground from the tip of the conductive rod.

Z1 ideally should be equal to Z2. If Z1 does not equal Z2, there will not be electrical symmetry and there will not be perfect balance at outputs. Moreover, Z1 and Z2 should be large compared to the characteristic impedance of the coaxial line 22.

The first and second ferrite beads 15A and 15B, are used to make Z1 and Z2 large at the lower end of the frequency range. In the preferred embodiment, the ferrite beads provide a significant series impedance from several MHZ to GHZ. Above this frequency range, the first and second polyiron cones 16A and 16B, present a significant series impedance preventing large current flows.

The function of the polyiron cones can be understood by considering a first transmission line having an impedance Z1 formed between the outer conductor of the coaxial transmission line 11 and the inner surfaces of the conductive housing 19 and a second transmission line having an impedance Z2 formed with the conductive rod 18 being the inner conductor and the inner surfaces 19 of the conductive housing being the outer conductor. The dimensions of the rod and housing are selected so that the impedance Z2 is greater than Rs. The polyiron cones act as a matched load, similar in function to the load element in a sliding load. Over the frequency range of operation, the transmission line impedance Z2 is large compared to the characteristic impedance of coaxial line 22.

To the degree that symmetry can be achieved, Z1 will be approximately equal to Z2, thereby achieving good balance.

This invention provides broadband millimeter wave to microwave mixers, and further provides greatly extended low frequency performance. Additional configurations of the invention taught herein will be apparent to those of ordinary skill in the art, and all embodiments incorporating the principles set forth herein are intended to be encompassed in the claims set forth below.

We claim:

1. A broadband transmission line balun comprising:

a conductive housing;

a coaxial transmission line having an inner conductor and an outer conductor for inputting broadband signals into a first end of the conductive housing;

the conductive housing electrically connected to the outer conductor of the coaxial transmission line;

the outer conductor of the coaxial transmission line having a tip passing through a first set of one or more ferrite beads and a first polyiron cone within the conductive housing;

a conductive rod inserted into the conductive housing and electrically connected to the conductive housing;

the conductive rod passing through a second set of one or more ferrite beads and a second polyiron cone within the conductive housing, the tip of the conductive rod forming an electronic contact which connects with the inner conductor of the first transmission line in approximately the center portion of the conductive housing such that a relatively small gap is formed between the tip of the conductive rod to provide balanced broadband output signals in a frequency range from several megahertz to several gigahertz.

2. The balun as in claim 1 wherein the first and second ferrite beads provide a significant series impedance Z1 and Z2, respectively, in a frequency range from several megahertz to several gigahertz.

3. The balun as in claim 2 wherein the first and second polyiron cones provide a significant series impedance above the several gigahertz range preventing large current flows.

4. The balun as in claim 3 wherein the broadband input signals have a resistance Rs and wherein a first transmission line is formed with the outer conductor of the coaxial transmission line and the inner surfaces of the conductive housing having the impedance Z1 and wherein a second transmission line is formed with the conductive rod being the inner conductor and the inner surfaces of the conductive housing being the outer conductor and having the impedance Z2 greater than Rs and wherein impedance Z2 is approximately equal to impedance Z1.

5. The balun as in claim 4 wherein the input impedance Z1 is greater than the characteristic impedance ZO of the coaxial transmission line.

6. The balun as in claim 5 wherein the impedance Z2 is approximately equal to the impedance Z1 to provide a balanced output signal over the frequency range.

7. The balun as in claim 6 wherein Z2 represents the impedance to ground from the tip of the outer conductor of the coaxial transmission line.

8. The balun as in claim 7 wherein Z2 represents the impedance to ground from the tip of the conductive rod.

9. The balun as in claim 8 wherein the ferrite beads are operable to make Z1 and Z2 large at the lower end of the frequency range.

10. The balun as in claim 6 wherein the coaxial transmission line is unbalanced.

* * * * *